US010529266B2

(12) United States Patent
Huang

(10) Patent No.: US 10,529,266 B2
(45) Date of Patent: Jan. 7, 2020

(54) ELECTRONIC APPARATUS WITH DETECTION FUNCTION AND DISPLAY APPARATUS WITH DETECTION FUNCTION CAPABLE OF CALCULATING REMAINING SERVICE TIME OF NORMAL DRIVING CIRCUIT THEREOF

(71) Applicant: AU OPTRONICS CORPORATION, Hsin-chu (TW)

(72) Inventor: Yu-Jung Huang, Hsin-chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 32 days.

(21) Appl. No.: 15/935,387

(22) Filed: Mar. 26, 2018

(65) Prior Publication Data

US 2018/0277031 A1 Sep. 27, 2018

(30) Foreign Application Priority Data

Mar. 27, 2017 (TW) ..... 106110201 A

(51) Int. Cl.
*G09G 3/36* (2006.01)
*G09G 3/00* (2006.01)

(52) U.S. Cl.
CPC ..... *G09G 3/006* (2013.01); *G09G 2330/12* (2013.01); *G09G 2354/00* (2013.01)

(58) Field of Classification Search
CPC .. G09G 3/36; G09G 5/00; G06F 3/045; G06F 3/038
See application file for complete search history.

(56) References Cited

U.S. PATENT DOCUMENTS

2005/0280766 A1* 12/2005 Johnson ..... G09G 3/3216 349/167
2015/0029237 A1* 1/2015 Chen ..... G09G 3/3413 345/690

(Continued)

FOREIGN PATENT DOCUMENTS

CN 102262046 A 11/2011
CN 103675525 A 3/2014

OTHER PUBLICATIONS

Office Action issued by (TIPO) Intellectual Property Office, Ministry of Economic Affairs, R. O. C. dated Jan. 22, 2018 for Application No. 106110201, Taiwan.

*Primary Examiner* — Pegeman Karimi
(74) *Attorney, Agent, or Firm* — Tim Tingkang Xia, Esq.; Locke Lord LLP

(57) ABSTRACT

An electronic apparatus with a detection function includes a normal function circuit, a dummy function circuit and a processing module. The normal function circuit operates according to an operation signal. The dummy function circuit operates to generate a result signal according to a test signal and is a small size circuit of the normal function circuit. The test signal and operation signal are same function signals, and the test signal has an electrical characteristic larger than that of the operation signal. The processing module generates the operation signal and the test signal at the same time, accumulates an operation time of the dummy function circuit, and determines whether the dummy function circuit is faulty by detecting the result signal. When the dummy function circuit is faulty, the processing module calculates a remaining lifetime of the normal function circuit according to the test signal, the operation signal and the operation time.

10 Claims, 9 Drawing Sheets

(56) References Cited

U.S. PATENT DOCUMENTS

| | | | | |
|---|---|---|---|---|
| 2016/0078830 | A1* | 3/2016 | Huang | G09G 3/3406 345/691 |
| 2016/0314850 | A1* | 10/2016 | Gu | G11C 19/28 |
| 2018/0040382 | A1* | 2/2018 | Gu | G09G 3/3674 |
| 2018/0233209 | A1* | 8/2018 | Ma | H01L 27/1214 |

* cited by examiner

ELECTRONIC APPARATUS WITH DETECTION FUNCTION AND DISPLAY APPARATUS WITH DETECTION FUNCTION CAPABLE OF CALCULATING REMAINING SERVICE TIME OF NORMAL DRIVING CIRCUIT THEREOF

CROSS-REFERENCE TO RELATED PATENT APPLICATION

This non-provisional application claims priority to and the benefit of, pursuant to 35 U.S.C. § 119(a), patent application Serial No. 106110201 filed in Taiwan on Mar. 27, 2017. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to detection technologies of electronic apparatuses, and in particularly, to an electronic apparatus with a detection function and a display apparatus with a detection function.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

With the rapid progress of technologies, various new electronic apparatuses are continuously launched and widely applied to daily life of human beings. For example, because display apparatuses may be configured to display information to users, the display apparatuses are wildly applied to automobile instruments, billboards, mobile phones, computers, and the like.

It is well known that normal operation of each electronic apparatus not only depends on electrical actuation, but also needs to depend on control of each internal circuit inside the electronic apparatus, so that a correct service is provided to a user. Because each internal circuit has a service life, when any internal circuit is damaged or is faulty because its service life ends, it is likely the electronic apparatus cannot provide a correct service to a user, or even a status in which the service is stopped, and further, a lot of inconvenience is derived.

To prevent an electronic apparatus from a status that a service is abnormal, or even that a service is stopped, because an internal circuit is damaged or is faulty, how to predict a remaining service life of an internal circuit of an electronic apparatus to replace the internal circuit as early as possible to take preventive measures in advance is an important subject in the present technical field.

SUMMARY

In an embodiment, an electronic apparatus with a detection function includes a normal function circuit, a dummy function circuit, and a processing module. The normal function circuit operates according to an operation signal. The dummy function circuit operates according to a test signal to generate a result signal. The dummy function circuit is a small size circuit of the normal function circuit. The test signal and the operation signal are same function signals. The test signal has an electrical characteristic greater than that of the operation signal. The processing module generates the operation signal and the test signal at the same time and accumulates an operation time of the dummy function circuit. The processing module detects the result signal to determine whether the dummy function circuit is faulty. When the dummy function circuit is faulty, the processing module calculates a remaining service life of the normal function circuit according to the test signal, the operation signal, and the operation time.

In an embodiment, a display apparatus with a detection function includes a display panel, a normal driving circuit, a dummy driving circuit, and a processing module. The normal driving circuit drives the display panel according to an operation signal. The normal driving circuit includes a first quantity of driving units. The dummy driving circuit operates according to a test signal to generate a result signal. The dummy driving circuit includes a second quantity of the driving units, and the first quantity is greater than the second quantity. The test signal and the operation signal are same function signals, and the test signal has an electrical characteristic greater than that of the operation signal. The processing module generates the operation signal and the test signal at the same time and accumulates an operation time of the dummy driving circuit. The processing module detects the result signal to determine whether the dummy driving circuit is faulty. When the dummy driving circuit is faulty, the processing module calculates a remaining service life of the normal driving circuit according to the test signal, the operation signal, and the operation time.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
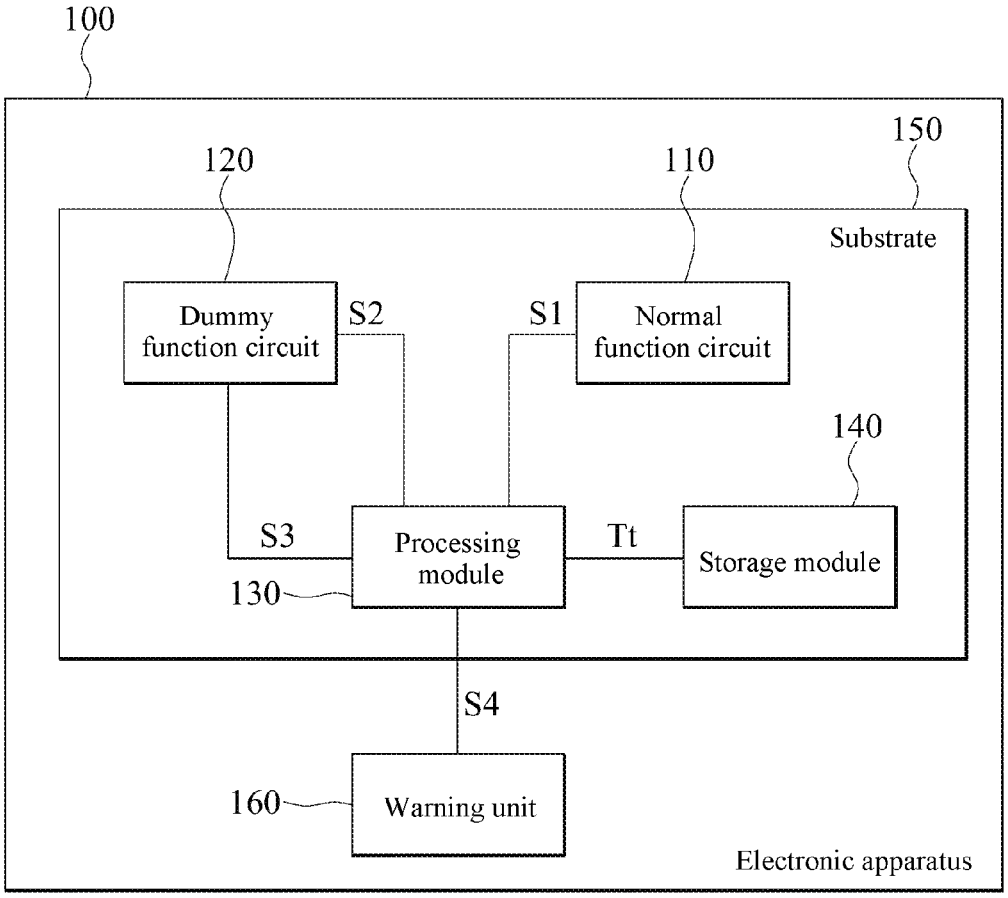
FIG. 1 is a brief schematic block diagram of an embodiment of an electronic apparatus with a detection function.

Embodiments accompanied with figures are described in detail below. However, the embodiments provided are not intended to limit the scope of the present disclosure. The description of structures and operations are not intended to limit the order of execution. Any structure formed by recombining elements shall fall within the scope of the present disclosure as long as an equivalent apparatus can be generated. In addition, the figures are merely provided for the purpose of description, but are not drawn to scale. Same or similar elements are denoted by same reference numerals in the following description to facilitate understanding.

Unless otherwise specified, each term used in the whole specification and the claims usually has a normal meaning that the term has when used in this field, in content of the present disclosure, and in special content.

FIG. 1 is a brief schematic block diagram of an embodiment of an electronic apparatus with a detection function. Referring to FIG. 1, an electronic apparatus 100 with a detection function includes a normal function circuit 110, a dummy function circuit 120, and a processing module 130. The processing module 130 is coupled to a normal function circuit 110 and a dummy function circuit 120. Generally, the normal function circuit 110, the dummy function circuit 120, and the processing module 130 are disposed inside a housing of the electronic apparatus 100.

Herein, the dummy function circuit 120 is a small size circuit of the normal function circuit 110, and when the normal function circuit 110 includes a first quantity of functional units with a same function, the dummy function circuit 120 may be constituted by a second quantity of functional units having a function the same as that of the normal function circuit 110, and the second quantity is smaller than the first quantity. That is, a circuit structure, an operation function, an operation manner, and the like of the dummy function circuit 120 are approximately the same as those of the normal function circuit 110. Therefore, the dummy function circuit 120 and the normal function circuit 110 are approximately the same circuit. The small size circuit illustrated in this embodiment, for example, may include a smaller quantity of functional units, or circuit components that constitute the functional units have smaller sizes.

The normal function circuit 110 operates according to an operation signal S1, and by means of operation of the normal function circuit 110, the electronic apparatus 100 can provide a corresponding service function to a user. The dummy function circuit 120 operates according to a test signal S2, to generate a result signal S3 and provide the result signal S3 to the processing module 130, and the processing module 130, for example, may determine whether the electronic apparatus 100 is faulty or is damaged according to the result signal S3.

Herein, the operation signal S1 and the test signal S2 are same function signals. The same function signals indicate that the two signals may be used to enable a same circuit or two circuits with a same function to perform a similar operation. However, the frequency, the strength, and the like of a function generated by operating according to the operation signal S1 and the frequency, the strength, and the like of a function generated by operating according to the test signal S2 may differ according to magnitudes of electrical characteristics of the operation signal S1 and the test signal S2. In addition, the test signal S2 has an electrical characteristic greater than that of the operation signal S1. For example, the electrical characteristic of the test signal S2 may be a multiple of that of the operation signal S1. In some embodiments, the electrical characteristics of the operation signal S1 and the test signal S2 may be frequencies, levels, or amplitudes of the signals.

The processing module 130 may be configured to generate the operation signal S1 and the test signal S2 at the same time, and respectively output the operation signal S1 and the test signal S2 to the normal function circuit 110 and the dummy function circuit 120, to drive the dummy function circuit 120 to operate according to the test signal S2 to generate the result signal S3 while driving the normal function circuit 110 to operate according to operation signal S1.

In addition, the processing module 130 may be configured to accumulate an operation time Tt of the dummy function circuit 120. The operation time Tt accumulated by the processing module 130 may be a total use time of the dummy function circuit 120, that is, after the electronic apparatus 100 is delivered, a sum of all operation periods during which the dummy function circuit 120 is used. Herein, because the normal function circuit 110 and the dummy function circuit 120 are simultaneously driven to operate, the operation time Tt of the dummy function circuit 120 accumulated by the processing module 130 is approximately equal to an accumulated operation time of the normal function circuit 110 (that is, a total operation time of the normal function circuit 110).

In an embodiment, the electronic apparatus 100 further includes a storage module 140, configured to store the operation time Tt accumulated by the processing module 130. In some embodiments, the storage module 140 may be implemented by one or more storage components. Each storage component may be a storage element of different types. For example, the storage component may be a non-volatile memory, such as a read-only memory (ROM) or a flash memory, or a volatile memory such as a random access memory.

The processing module 130 may further detect the result signal S3 generated by the dummy function circuit 120 to determine whether the dummy function circuit 120 is faulty or is damaged. In an embodiment, the processing module 130 may detect a signal level, a signal transition time point, a signal width, or the like of the result signal S3 and compare it with a pre-stored corresponding value, thereby further determining whether the dummy function circuit 120 is faulty or is damaged. However, no limitation is imposed in the present invention. In another embodiment, the processing module 130 may receive the result signal S3 generated by the dummy function circuit 120 and compare the result signal S3 with a default signal, to determine whether the dummy function circuit 120 can generate a result signal S3 approximately the same as the default signal. When a result of comparing the signal level, the signal transition time point, the signal width, or the like of the received result signal S3 with the pre-stored corresponding value or that of the default signal shows a great difference, it can be determined that the dummy function circuit 120 is faulty or is damaged.

In an embodiment, the result signal S3 generated by the dummy function circuit 120 may include a plurality of sub-result signals. In addition, a quantity of sub-result signals may be approximately the same as a quantity of functional units included in the dummy function circuit 120.

When the result signal S3 is not in an expected signal aspect, the processing module 130 may determine that the dummy function circuit 120 is faulty or is damaged, and calculate the remaining service life of the normal function circuit 110 according to the test signal S2, the operation signal S1, and the operation time Tt.

In an embodiment, the processing module 130 may calculate the remaining service life of the normal function circuit 110 according to a relationship between the electrical characteristic of the test signal S2 and the electrical characteristic of operation signal S1 and the operation time Tt. For example, the processing module 130 may first calculate a ratio of a frequency of the test signal S2 to a frequency of the operation signal S1, and then, subtract the operation time Tt from a product obtained by multiplying the obtained ratio by the operation time Tt, to obtain a remaining use life of the normal function circuit 110. Therefore, the remaining use life may be represented by using the following formula 1:

$$Tr = Tt * \left(\frac{f2}{f1} - 1\right) \quad \text{Formula 1}$$

Tr is a remaining service life, Tt is an operation time, f1 is a frequency of the operation signal S1, and f2 is a frequency of the test signal S2.

For example, it is assumed that a ratio of a frequency of the test signal S2 to a frequency of the operation signal S1 is 2, indicating a current operation frequency of the dummy function circuit 120 is two times that of the normal function circuit 110. When the processing module 130 determines that the dummy function circuit 120 works normally, a frequency of the result signal S3 generated by the dummy function circuit 120 may be two times a frequency of an output signal generated by the normal function circuit 110 according to the operation signal S1. On the contrary, when the processing module 130 determines that the dummy function circuit 120 is faulty or is damaged, the processing module 130 may learn, according to the formula 1, that the remaining service life of the normal function circuit 110 is approximately ½ of the service life.

In an embodiment, after determining that the dummy function circuit 120 is faulty or is damaged, the processing module 130 may further generate a warning signal S4, to warn a user to perform corresponding processing, such as replacement, on the electronic apparatus 100.

In an embodiment, the electronic apparatus 100 further includes a warning unit 160, and the warning unit 160 is coupled to the processing module 130. The warning unit 160 may issue warning information according to the warning signal S4. For example, the warning unit 160 may be a display component, such as a light-emitting diode or a display screen, and may emit light rays, flash, or display warning information after receiving the warning signal S4 to prompt a user. For another example, the warning unit 160 may be an audio unit, such as a buzzer, and may make a sound after receiving the warning signal S4 to prompt a user. For still another example, the warning unit 160 may be a wireless sending unit, and may send information to a user after receiving the warning signal S4, for example, send a short message to a mobile apparatus of a user or send an email to an email box of a user, to prompt the user.

In an embodiment, the electronic apparatus 100 further includes a substrate 150, and the normal function circuit 110, the dummy function circuit 120, and the processing module 130 may be disposed on the substrate 150. In addition, the storage module 140 may also be disposed on the substrate 150.

In an embodiment, the normal function circuit 110 and the dummy function circuit 120 are formed in a same process procedure, to reduce the differences due to a process variation on the normal function circuit 110 and the dummy function circuit 120. For example, the substrate 150 may be a carrier substrate used for forming an integrated circuit, and the normal function circuit 110 and the dummy function circuit 120 may be formed together on the substrate 150 by means of a process of the integrated circuit.

In some embodiments, the electronic apparatus 100 may be a display apparatus 200, an Internet of Things apparatus, or any other electronic product having an internal circuit.

Figure 2:
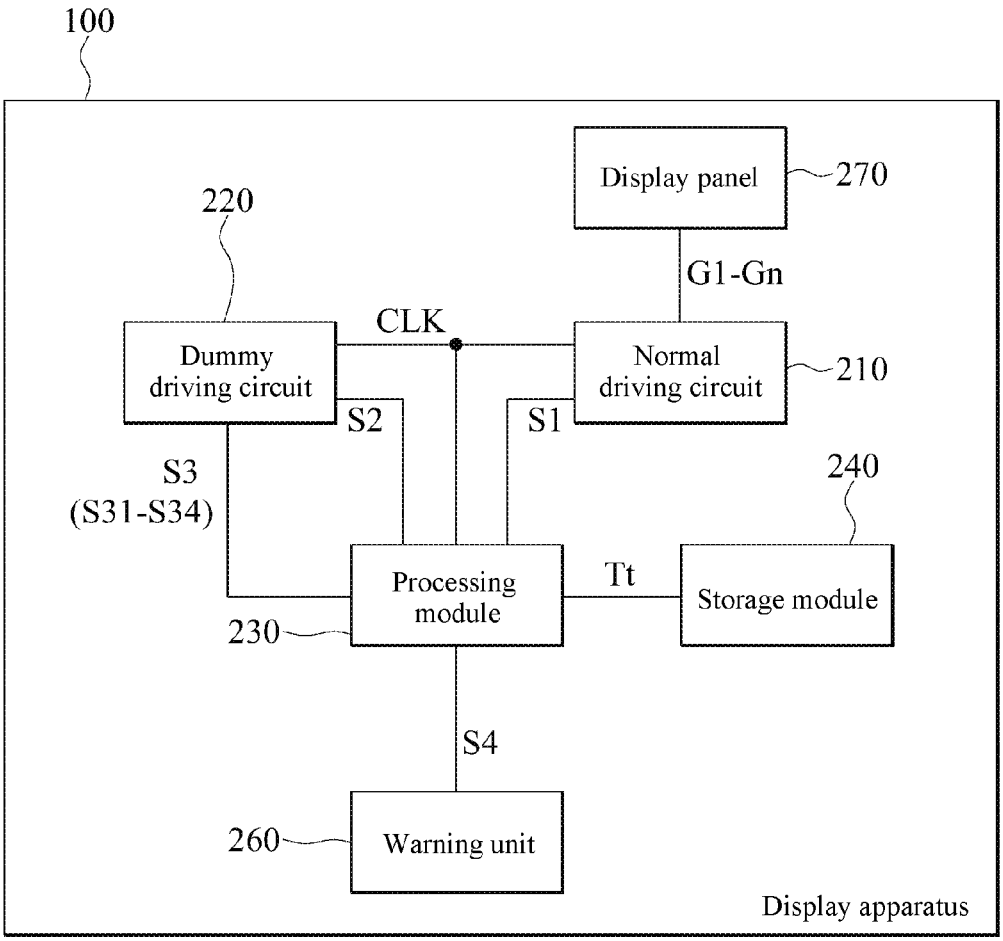
FIG. 2 is a brief schematic block diagram of an embodiment of a display apparatus with a detection function.

FIG. 2 is a brief schematic block diagram of an embodiment of a display apparatus capable of predicting a remaining service life. Referring to FIG. 2, an example in which a display apparatus 200 serves as the electronic apparatus 100 is used for description. However, no limitation is imposed in the present invention.

The display apparatus 200 includes a normal driving circuit 210, a dummy driving circuit 220, a processing module 230, and a display panel 270. The processing module 230 is coupled to the normal driving circuit 210 and the dummy driving circuit 220, and the normal driving circuit 210 is coupled to the display panel 270. The normal driving circuit 210 is a preferred example of the normal function circuit 110, the dummy driving circuit 220 is a preferred example of the dummy function circuit 120, and the processing module 230 is a preferred example of the processing module 130.

Figure 3:
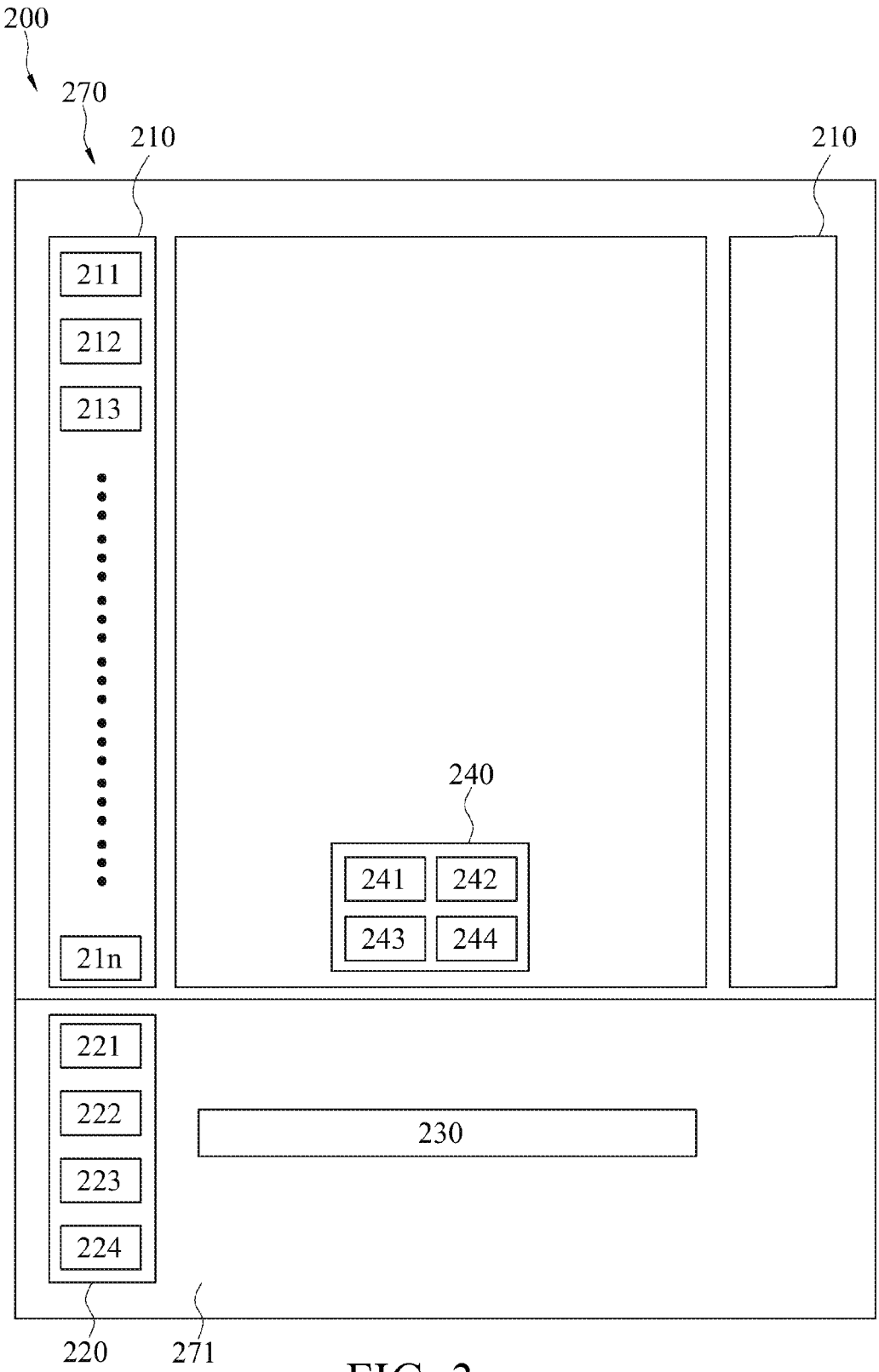
FIG. 3 is a brief block diagram of an embodiment of a display apparatus with a detection function.

FIG. 3 is a brief block diagram of an embodiment of a display apparatus with a detection function. Referring to FIG. 2 and FIG. 3, the normal driving circuit 210 has a first quantity of driving units 211 to 21*n*, and the dummy driving circuit 220 has a second quantity of driving units 221 to 224, where n is a positive integer. Hence, the driving units 211 to 21*n* and the driving unit 221 to 224 are approximately the same in terms of a circuit structure, an operational function, and an operation function, and the first quantity is greater than the second quantity. In other words, the dummy driving circuit 220 is a small size circuit of the normal driving circuit 210. The small size circuit, for example, may include a smaller quantity of functional units, or circuit components that constitute the functional units have smaller sizes.

The normal driving circuit 210 drives the display panel 270 according to an operation signal S1. The dummy driving circuit 220 operates according to a test signal S2 to generate a result signal S3 and provides it to the processing module 230, which determines whether there is a fault or damage.

Herein, the operation signal S1 and the test signal S2 are same function signals and may be respectively used to enable the normal driving circuit 210 and the dummy driving circuit 220 that have a same function to perform similar operations. In addition, the test signal S2 has an electrical characteristic greater than that of the operation signal S1, so that an operation condition of the dummy driving circuit 220 is tougher than that of the normal driving circuit 210. In some embodiments, the electrical characteristic may be a frequency, a level, or an amplitude. For example, a frequency of the test signal S2 may be greater than a frequency of the operation signal S1, so that an operation frequency (that is, an operation condition) of the dummy driving circuit 220 is greater than an operation frequency of the normal driving circuit 210. For an example, a level of the test signal S2 may be greater than a level of the operation signal S1, so that an operation level (that is, an operation condition) of the dummy driving circuit 220 is greater than an operation level of the normal driving circuit 210.

The processing module 230 generates an operation signal S1 and provides it to the normal driving circuit 210, and at the same time, generates a test signal S2 and provides it to the dummy driving circuit 220, so as to enable the dummy driving circuit 220 to operate to generate a result signal S3 while enabling the normal driving circuit 210 to drive the display panel 270.

In addition, the processing module 230 accumulates an operation time Tt of the dummy driving circuit 220. The accumulated operation time Tt of the dummy driving circuit 220 may be a total use time of the dummy driving circuit 220. Herein, because the normal driving circuit 210 and the dummy driving circuit 220 are simultaneously driven, the operation time Tt of the dummy driving circuit 220 accumulated by the processing module 230 is approximately equal to an accumulated operation time of the normal driving circuit 210 (that is, a total operation time of the normal driving circuit 210).

The processing module 230 may further detect the result signal S3 generated by the dummy driving circuit 220 to determine whether the dummy driving circuit 220 is faulty or is damaged. In an embodiment, the processing module 230 may detect a signal level, a signal transition time point, a signal width, or the like of the result signal S3 and compare it with a pre-stored corresponding value, thereby further determining whether the dummy driving circuit 220 is faulty or is damaged. However, no limitation is imposed in the present invention. In another embodiment, the processing module 230 may receive the result signal S3 generated by the dummy driving circuit 220 and compare the result signal S3 with a default signal, to determine whether the dummy driving circuit 220 can generate a result signal S3 approximately the same as the default signal.

In an embodiment, the result signal S3 generated by the dummy driving circuit 220 may include a plurality of sub-result signals S31 to S34. In addition, a quantity of sub-result signals S31 to S34 may be approximately the same as a quantity of driving units 221 to 224 included in the dummy driving circuit 220.

Figure 4:
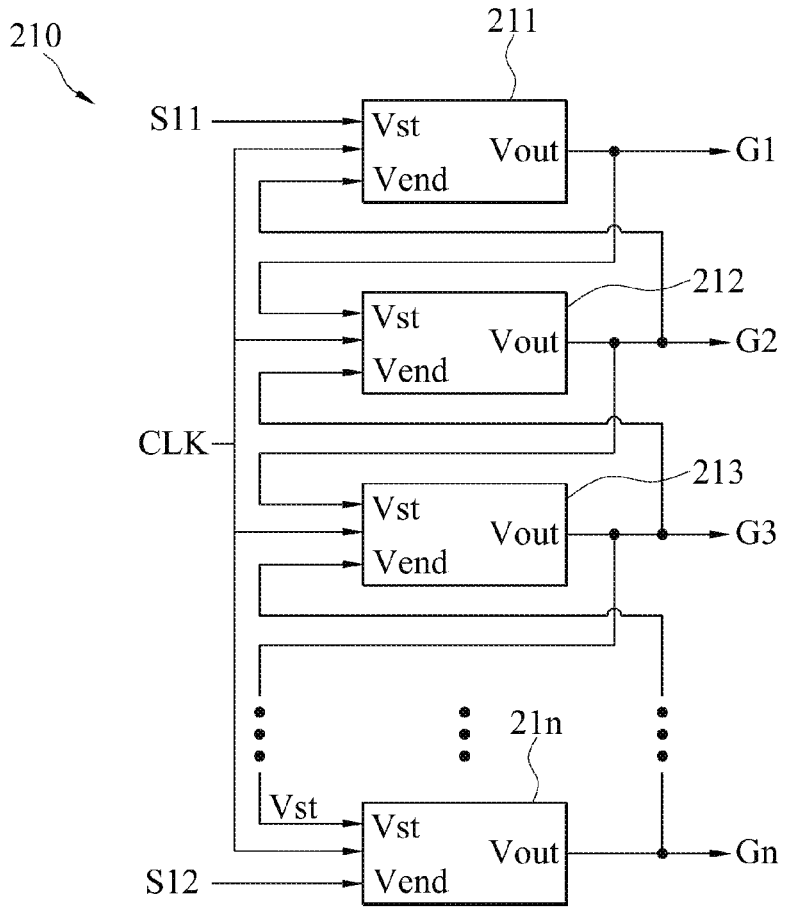
FIG. 4 is a brief schematic diagram of an embodiment of a normal driving circuit.
Figure 5:
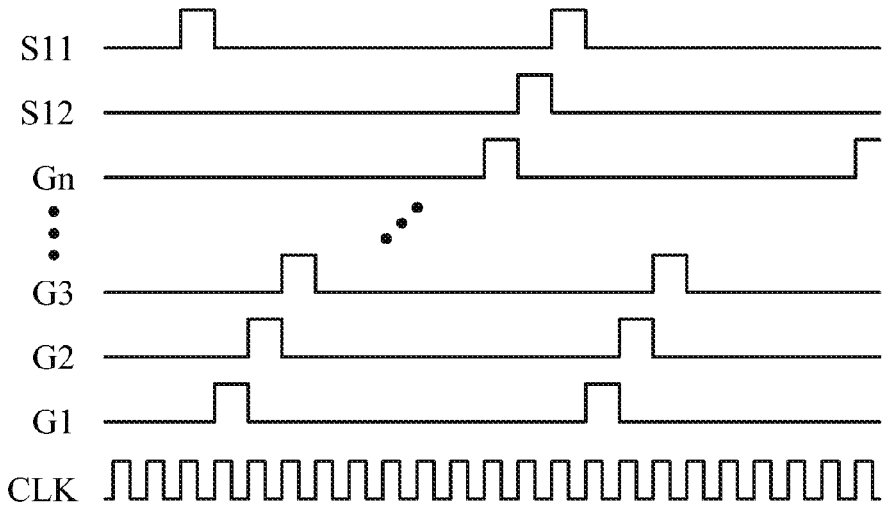
FIG. 5 is a brief schematic diagram of an embodiment of a first enable signal, a first disable signal, a scan signal, and a frequency signal in FIG. 4.

In an embodiment, the normal driving circuit 210 may be used to generate a plurality of scan signals G1 to Gn and provide them to the display panel 270. FIG. 4 is a brief schematic diagram of an embodiment of a normal driving circuit, and FIG. 5 is a brief schematic diagram of an embodiment of a first enable signal, a first disable signal, a scan signal, and a frequency signal in FIG. 4. Referring to FIG. 2 to FIG. 5, in an embodiment, the operation signal S1 may include a first enable signal S11 and a first disable signal S12. Driving units 211 to 21*n* are sequentially connected in series, and the driving units 211 to 21*n* may sequentially generate scan signals G1 to Gn according to a frequency signal CLK, a first enable signal S11, and a first disable signal S12, so as to drive the display panel 270 to perform display.

For example, each of the driving units 211 to 21*n* may receive the frequency signal CLK. In addition, an enable end Vst of the driving unit 211 is coupled to the first enable signal S11, to generate a scan signal G1 according to the frequency signal CLK and the first enable signal S11, and a disable end Vend of the driving unit 211 is coupled to an output end Vout of the driving unit 212, to perform disabling according to the frequency signal CLK and a scan signal G2 output by the driving unit 212. An enable end Vst of the driving unit 212 is coupled to the scan signal G1, to generate a scan signal G2 according to the frequency signal CLK and the scan signal G1, and a disable end Vend of the driving unit 212 is coupled to an output end Vout of the driving unit 213, to perform disabling according to the frequency signal CLK and the scan signal G3 output by the driving unit 213, and so on until the driving unit 21*n*. In other words, the frequency signal CLK may be used to synchronize the driving units 211 to 21*n*, the scan signals G1 to Gn generated by the driving units 211 to 21*n* may be used to enable driving units of their next stages, and the scan signals G1 to Gn generated by the driving units 211 to 21*n* may further be used to disable driving units of their previous stages. Herein, because the driving unit 211 is in a first stage, the driving unit 211 is enabled by the first enable signal S11. In addition, because the driving unit 21*n* is a last stage, the driving unit 21*n* is disabled by the first disable signal S12.

Figure 6:
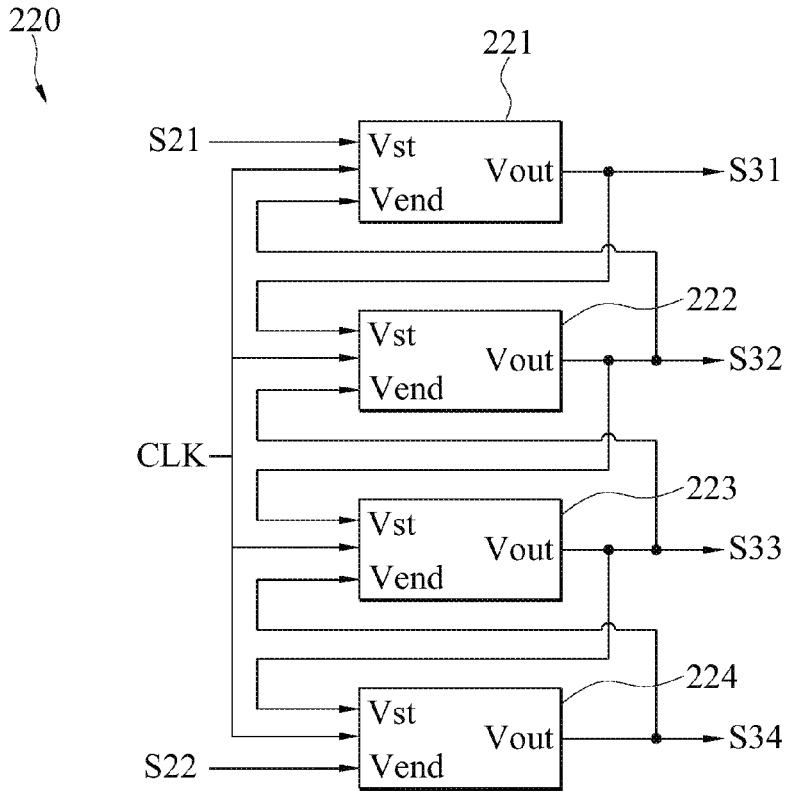
FIG. 6 is a brief schematic diagram of an embodiment of a dummy driving circuit.
Figure 7:
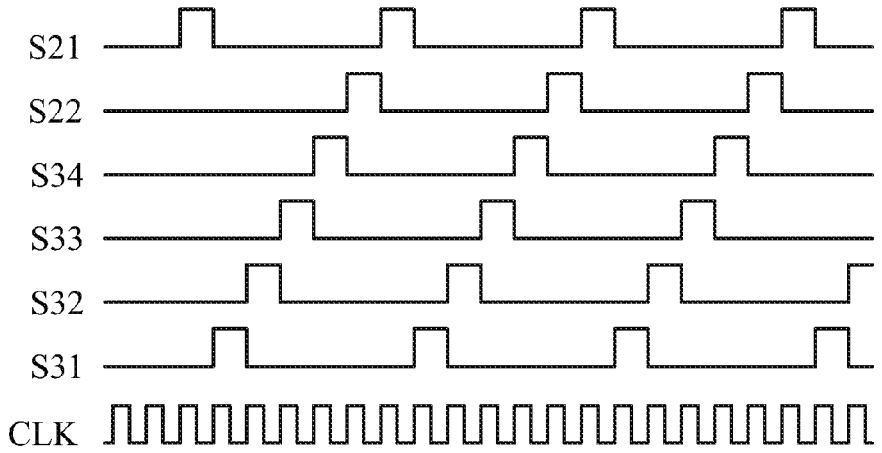
FIG. 7 is a brief schematic diagram of an embodiment of a second enable signal, a second disable signal, a sub-result signal, and a frequency signal in FIG. 6.

FIG. 6 is a brief schematic diagram of an embodiment of a dummy driving circuit, and FIG. 7 is a brief schematic diagram of an embodiment of a second enable signal, a second disable signal, a sub-result signal, and a frequency signal in FIG. 6. Referring to FIG. 2 to FIG. 7, in an embodiment, the test signal S2 may include a second enable signal S11 and a second disable signal S12.

Driving units 221 to 224 are sequentially connected in series, and the driving units 221 to 224 may sequentially generate sub-result signals S31 to S34 according to a frequency signal CLK, a second enable signal S21, and a second disable signal S22 and provide them to a processing module 230 for determination.

For example, each of the driving units 221 to 214 may receive the frequency signal CLK. In addition, an enable end Vst of the driving unit 221 receives the second enable signal S21, to generate a sub-result signal S31 according to the frequency signal CLK and the second enable signal S21, and a disable end Vend of the driving unit 221 is coupled to an output end Vout of the driving unit 222, to perform disabling according to the frequency signal CLK and an sub-result signal S32 output by the driving unit 222. An enable end Vst of the driving unit 222 receives the sub-result signal S31, to generate an sub-result signal S32 according to the frequency signal CLK and the sub-result signal S31, and a disable end Vend of the driving unit 222 is coupled to an output end Vout of the driving unit 223, to perform disabling according to the frequency signal CLK and a sub-result signal S33 output by the driving unit 223. An enable end Vst of the driving unit 223 receives the sub-result signal S32, to generate an sub-result signal S33 according to the frequency signal CLK and the sub-result signal S32, and a disable end Vend of the driving unit 223 is coupled to an output end Vout of the driving unit 224, to perform disabling according to the frequency signal CLK and a sub-result signal S34 output by the driving unit 224. An enable end Vst of the driving unit 224 is coupled to a sub-result signal S33, to generate a sub-result signal S34 according to the sub-result signal S33, and a disable end Vend of the driving unit 224 receives a second disable signal S22, to perform disabling according to the frequency signal CLK and the second disable signal S22.

Herein, as shown in FIG. 5 and FIG. 7, the frequency signal CLK used by the dummy driving circuit 220 is approximately the same as the frequency signal CLK used by the normal driving circuit 210, but a frequency of the second enable signal S21 used by the dummy driving circuit 220 is greater than a frequency of the first enable signal S11 used by the normal driving circuit 210, and a frequency of the second disable signal S22 used by the dummy driving circuit 220 is greater than a frequency of the first disable signal S12 used by the normal driving circuit 210, so that an operation frequency of the dummy driving circuit 220 is greater than an operation frequency of the normal driving circuit 210.

When the sub-result signals S31 to S34 are not in an expected signal aspect, for example, when a signal level, a signal transition time point, or a signal width of any one of the sub-result signals S31 to S34 is different from an expected one, the processing module 230 may determine that the dummy driving circuit 220 is faulty or is damaged, and calculate a remaining service life of the normal driving circuit 210 according to a test signal S2, an operation signal S1, and an operation time Tt.

In an embodiment, the processing module 230 may calculate the remaining service life of the normal driving circuit 210 according to a relationship between the electrical characteristic of the test signal S2 and the electrical characteristic of operation signal S1 and the operation time Tt. For example, the processing module 230 may first calculate a ratio of a frequency of the test signal S2 to a frequency of the operation signal S1, and then, subtract the operation time Tt from a product obtained by multiplying the obtained ratio by the operation time Tt, to obtain a remaining use life of the normal driving circuit 210. In some embodiments, a frequency of the operation signal S1 may be an operation frequency of the first enable signal S11, and a frequency of the test signal S2 may be an operation frequency of the second enable signal S21. In some embodiments, a frequency of the operation signal S1 may be an operation frequency of the first disable signal S12, and a frequency of the test signal S2 may be an operation frequency of the second disable signal S22.

For example, it is assumed that a ratio of a frequency of the test signal S2 to a frequency of the operation signal S1 is 2, indicating a current operation frequency of the dummy driving circuit 220 is two times that of the normal driving circuit 210. When the processing module 230 determines that the dummy driving circuit 220 works normally, a frequency of each of the sub-result signals S31 to S34 generated by the dummy driving circuit 220 may be two times a frequency of the scan signals G1 to Gn generated by the normal driving circuit 210 according to the operation signal S1. On the contrary, when the processing module 230 determines that the dummy driving circuit 220 is faulty or is damaged, the processing module 230 may learn, according to the formula 1, that the remaining service life of the normal driving circuit 210 is approximately ½ of the service life.

In an embodiment, after determining that the dummy driving circuit 220 is faulty or is damaged, the processing module 230 may further generate a warning signal S4, to warn a user to perform corresponding processing, such as replacement, on the electronic apparatus 200, so as to prevent operation of the display apparatus 200 from being stopped.

In an embodiment, as shown in FIG. 2, the display apparatus 200 further includes a warning unit 260, and the warning unit 260 is coupled to the processing module 230. The warning unit 260 may issue warning information according to the warning signal S4. For example, the warning unit 260 may be a display component, such as a light-emitting diode or a display screen, and may emit light rays or display warning information after receiving the warning signal S4 to prompt a user. In some embodiments, the warning unit 260 may be implemented by using a warning signal S4. In other words, the processing module 230 may generate a warning signal S4 and enable the warning unit 260 to emit particular light rays, flash, or directly display warning information to prompt a user. For another example, the warning unit 260 may be an audio unit, such as a buzzer, and may make a sound after receiving the warning signal S4 to prompt a user. For still another example, the warning unit 260 may be a wireless sending unit, and may send information to a user after receiving the warning signal S4, for example, send a short message to a mobile apparatus of a user or send an email to an email box of a user, to prompt the user.

In an embodiment, as shown in FIG. 2, the display apparatus 200 further includes a storage module 240, configured to store the operation time Tt accumulated by the processing module 230.

In an embodiment, as shown in FIG. 3, a display panel 270 may include a substrate 271, and a normal driving circuit 210, a dummy driving circuit 220, and a processing module 230 may be disposed on the substrate 271. In addition, a storage module 240 may also be disposed on the substrate 271.

In some embodiments, the storage module 240 may be implemented by one or more storage components 241 to 244. Herein, four storage components 241 to 244 are used as an example. However, no limitation is imposed on a quantity thereof. For example, each of the storage components 241 to 244 may be a non-volatile memory, such as a read-only memory (ROM) or a flash memory, or a volatile memory such as a random access memory.

In some embodiments, each of the storage components 241 to 244 may implement a non-volatile memory structure by using a transistor such as a thin-film transistor (TFT), so as to be integrated into a process of the display panel 270.

Figure 8:
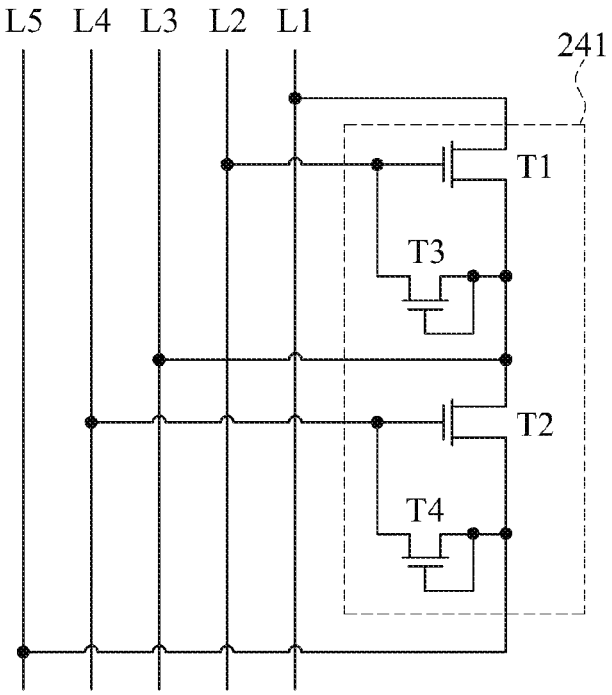
FIG. 8 is a brief schematic diagram of an embodiment of a storage component.

FIG. 8 is a brief schematic diagram of an embodiment of a storage component. Referring to FIG. 8, herein, a storage component 241 is used as an example for description.

In an embodiment, the storage component 241 may include two transistors T1 and T2, and the two transistors T1 and T2 are connected in series to each other. For example, a first end of the transistor T2 is coupled to a second end of the transistor T1. A control end of the transistor T1 is coupled to a second end thereof, and a control end of the transistor T2 is coupled to a second end thereof. In addition, the storage component 241 may further includes two transistors T3 and T4. The transistor T3 is coupled between the control end of the transistor T1 and the second end of the transistor T1, and the transistor T4 is coupled to the control end of the transistor T2 and the second end of the transistor T2. For example, a first end of the transistor T3 is coupled to the control end of the transistor T1, and a control end of the transistor T3 is coupled to a second end of the transistor T3, the second end of the transistor T1, and the first end of the transistor T2. A first end of the transistor T4 is coupled to the control end of the transistor T2, and a control end of the transistor 4 is coupled to a second end of the transistor 4 and the second end of the transistor T2.

Figure 9:
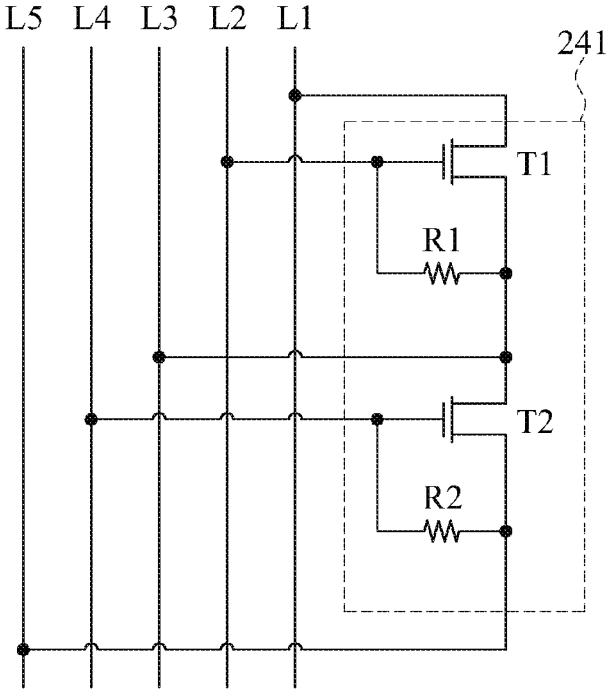
FIG. 9 is a brief schematic diagram of another embodiment of the storage component.

Herein, the transistor T3 may be equivalent to a resistor connected in series between the control end of the transistor T1 and the second end of the transistor T1, and the transistor T4 may be equivalent to a resistor connected in series between the control end of the transistor T2 and the second end of the transistor T2. Therefore, in some embodiments, a resistor R1 may be directly connected in series between the control end of the transistor T1 and the second end of the transistor T1, and a resistor R2 may be directly connected in series between the control end of the transistor T2 and the second end of the transistor T2, as shown in FIG. 9.

Generally, a write action on the storage component 241 may be performed by changing threshold voltages of the transistors T1, T2, so as to write logic "0" or logic "1". When the threshold voltage of the transistor T1 is greater than the threshold voltage of the transistor T2, logic "0" may be written into the storage component 241, and when the threshold voltage of the transistor T1 is smaller than the threshold voltage of the transistor T2, logic "1" may be written into the storage component 241. In addition, the write action of the storage component 241 may be divided into two steps, and differs according to whether a written value is logic "0" or logic "1".

In an embodiment, the storage component 241 further includes five transmission lines L1 to L5. Referring to FIG. 8, the transmission line L1 is coupled to the first end of the transistor T1. The transmission line L2 is coupled to the control end of the transistor T1 and the first end of the transistor T3. The transmission line L3 is coupled to the second end of the transistor T1, the first end of the transistor T2, and the second end and the control end of the transistor T3. The transmission line L4 is coupled to the control end of the transistor T2 and the first end of the transistor T4. The transmission line L5 is coupled to the second end of the transistor T2 and the second end and the control end of the transistor T4.

When a value to be written by the processing module 230 is logic "0", the processing module 230 may first increase a threshold voltage of the transistor T1 by applying a low level to the first end of the transistor T1, the second end of the transistor T1, and the control end of the thin-film transistor T2 and the second end of the transistor T2, and applying a high level to the control end of the transistor T1, and then, reduce a threshold voltage of the transistor T2 by applying a high level to the first end of the transistor T1, the control end of the transistor T1, the second end of the transistor T1, and the second end of the transistor T2, and applying a low level to the control end of the transistor T2, so as to complete writing of logic "0". In other words, the processing module 230 first outputs a high level by using the transmission line L2 and outputs a low level by using the rest of the transmission lines L1, and L3 to L5, and then, the processing module 230 outputs a low level by using the transmission line L4, and outputs a high level by using the rest of the transmission lines L1 to L3 and L5, so as to complete writing of logic "0".

When a value to be written by the processing module 230 is logic "1", the processing module 230 may first decrease a threshold voltage of the transistor T1 by applying a high level to the first end of the transistor T1, the second end of the transistor T1, and the control end of the thin-film transistor T2 and the second end of the transistor T2, and applying a low level to the control end of the transistor T1, and then, increase a threshold voltage of the transistor T2 by applying a low level to the first end of the transistor T1, the control end of the transistor T1, the second end of the transistor T1, and the second end of the transistor T2, and applying a high level to the control end of the transistor T2, so as to complete writing of logic "1". In other words, the processing module 230 first outputs a low level by using the transmission line L2 and outputs a high level by using the rest of the transmission lines L1, and L3 to L5, and then, the processing module 230 outputs a high level by using the transmission line L4, and outputs a low level by using the rest of the transmission lines L1 to L3 and L5, so as to complete writing of logic "1".

In addition, in an access action on the storage component 241, a value stored in the storage component 241 may be obtained by applying a high level to the first end of the transistor T1 and applying a low level to the second end of the transistor T2, by making a gate voltage Vgs1 (that is, a voltage difference between a gate and a source) of the transistor T1 and a gate voltage Vgs2 of the transistor T2 be 0 volt (V), and by reading a level on the second end of the transistor T1 or a level on the first end of the transistor T2 (that is, reading a level on a junction between the transistor T1 and the transistor T2). Therefore, in an embodiment, the processing module 230 may output a high level by using the transmission line L1, output a low level by using the transmission line L5, and read a value stored in the storage component 241 by using the transmission line L3. The processing module 230 does not output any signal by using the transmission lines L2 and L4. In other words, when a value is read from the storage component 241, the transmission line L3 is used as a read line.

In some embodiments, a high level may be 15 volts, and a low level may be −15 volts. However, no limitation is imposed in the present invention.

Figure 10:
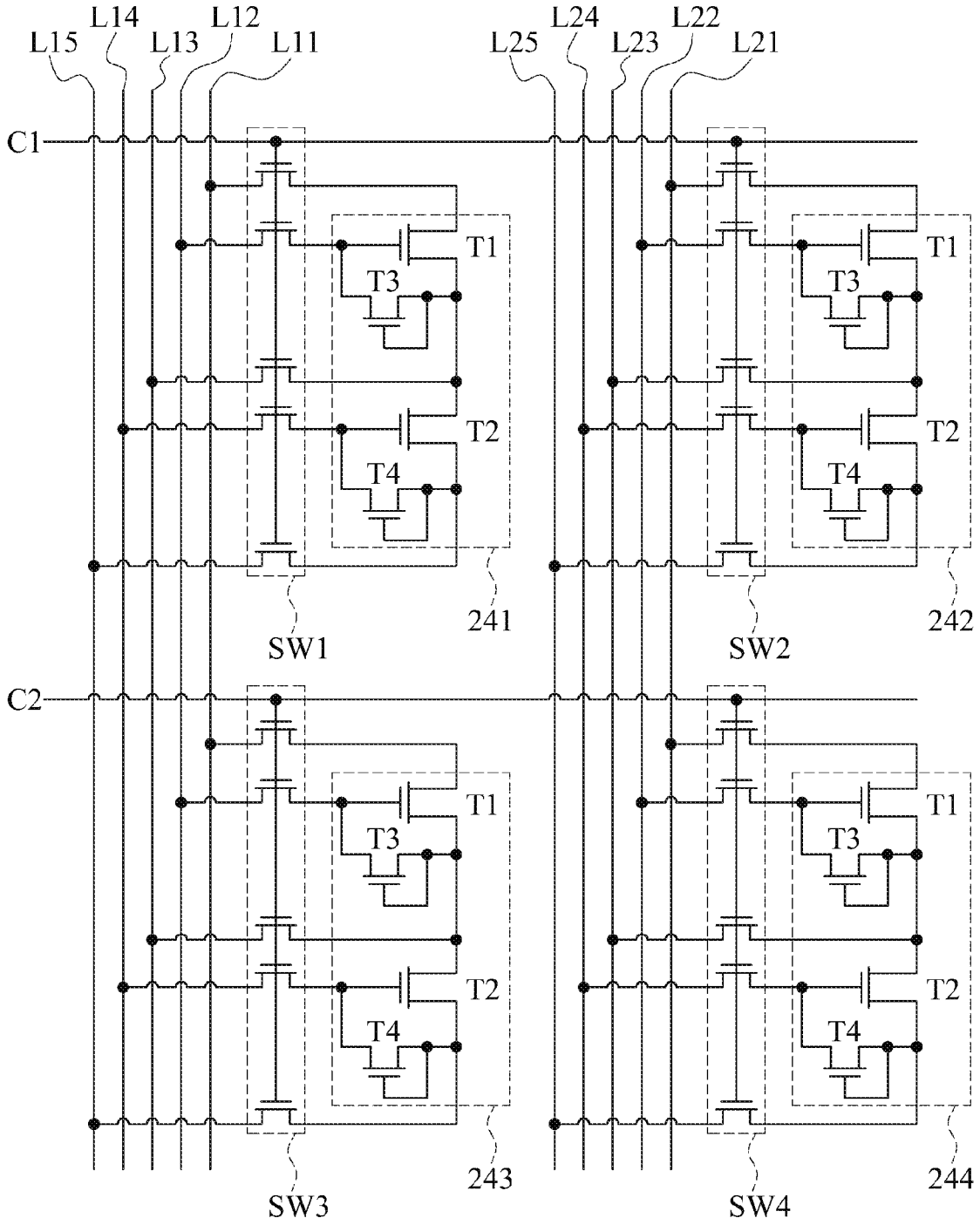
FIG. 10 is a brief schematic diagram of an embodiment of a storage module.

FIG. 10 is a brief schematic diagram of an embodiment of a storage module. Referring to FIG. 10, storage components 241 to 244 may be arranged as a matrix. For example, the storage components 241 and 242 are located on a same horizontal line, and the storage component 243 and 244 are located on a same horizontal line, as shown in FIG. 10. Herein, storage components arranged on a same vertical line may share a same group of transmission lines. For example, the storage components 241 and 243 may share transmission lines L11 to L15, and the storage components 242 and 242 may share transmission lines L22 to L25, as shown in FIG. 10.

The storage module 240 further includes a plurality of switch modules SW1 to SW4 and a plurality of control lines C1 and C2. A quantity of switch modules SW1 and SW4 may correspond to a quantity of storage components 241 to 244. In an embodiment, a quantity of control lines C1 and C2 may correspond to a quantity of horizontal lines of the arranged matrix of the storage components 241 to 244, and the storage components 241 to 244 located on the same horizontal lines may be coupled to the control lines C1 and C2 by using the corresponding switch modules SW1 to SW4.

For example, the storage component 241 may be coupled to the switch module SW1, and the switch module SW1 is coupled to the control line C1. The storage component 242 may be coupled to the switch module SW2, and the switch module SW2 may be coupled to the control line C1. The storage component 243 may be coupled to the switch module SW3, and the switch module SW3 is coupled to the control line C2. The storage component 244 may be coupled to the switch module SW4, and the switch module SW4 may be coupled to the control line C2. Therefore, the control lines C1 and C2 may be provided for the processing module 230 to select a horizontal line to drive. In some embodiments, the control lines C1 and C2 are used to receive sub-result signals generated by the dummy driving circuit 220.

Figure 11:
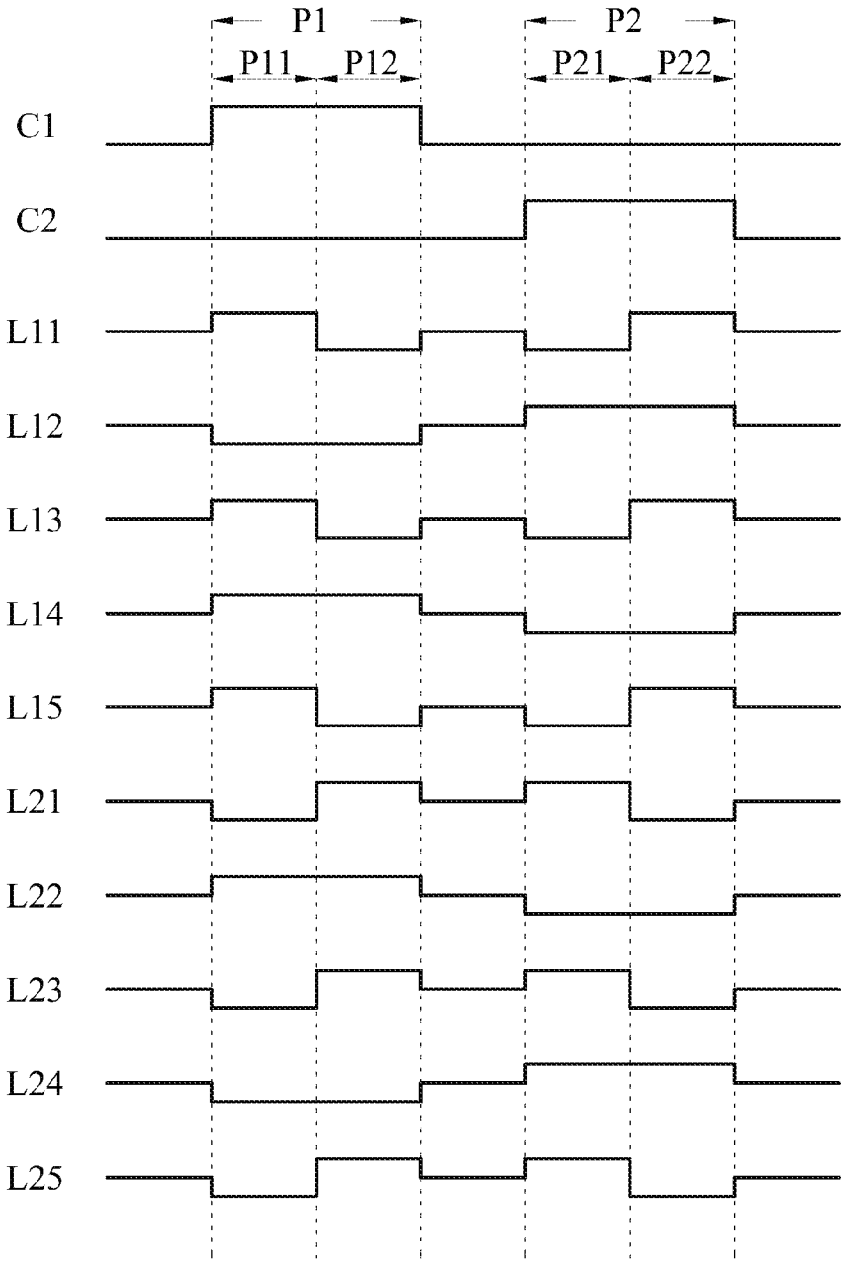
FIG. 11 is a schematic sequence diagram of an embodiment of a storage module performing a write operation.

FIG. 11 is a schematic sequence diagram of an embodiment of a storage module performing a write operation. Referring to FIG. 10 and FIG. 11, in a first period P1, the processing module 230 may output a high level by using the control line C1, to enable the storage components 241 and 242 on a first horizontal line to perform a write action. In addition, in a second period P2, the processing module 230 may output a high level by using the control line C2, to enable the storage components 243 and 244 on a second horizontal line to perform a write action. The first period P1 includes a first timeslot P11 and a second timeslot P12, and the second period P2 includes a third timeslot P21 and a fourth timeslot P22.

In the first timeslot P11 of the first period P1, the processing module 230 may output a high level by using the transmission lines L11, L13 to L15, and L22, and output a low level by using the transmission lines L12, L21, and L23 to L25. Subsequently, in the second timeslot P12 of the first period P1, the processing module 230 may output a high level by using the transmission lines L14, L21 to L23, and L25, and output a low level by using the transmission lines L11 to L13, L15, and L24, so as to complete write actions of writing logic "1" and logic "0" respectively in the storage components 241 and 242.

In the third timeslot P21 of the second period P2, the processing module 230 may output a low level by using the transmission lines L11, L13 to L15, and L22, and output a high level by using the transmission lines L12, L21, and L23 to L25. Subsequently, in the fourth timeslot P22 of the first period P2, the processing module 230 may output a low level by using the transmission lines L14, L21 to L23, and L25, and output a high level by using the transmission lines L11 to L13, L15, and L24, so as to complete write actions of writing logic "0" and logic "1" respectively in the storage components 243 and 244.

Figure 12:
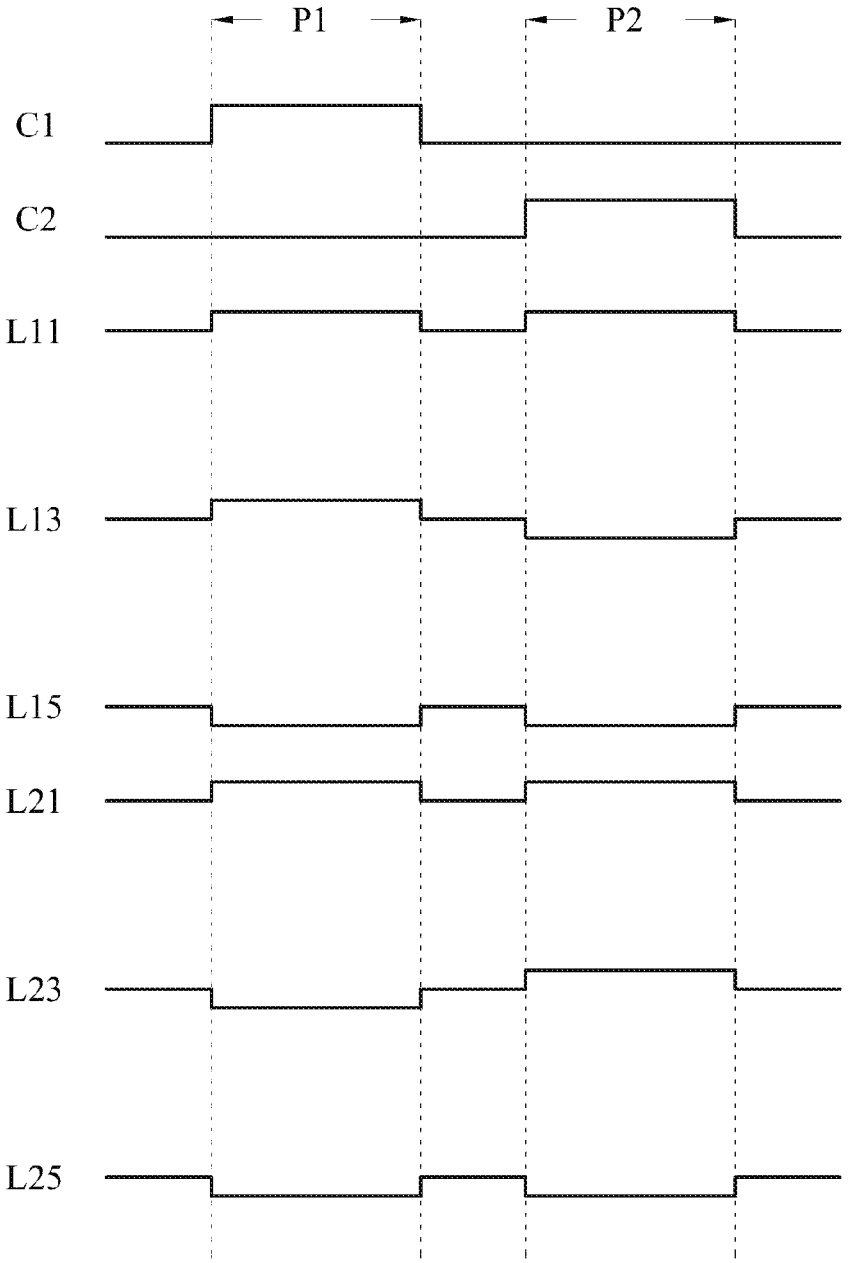
FIG. 12 is a schematic sequence diagram of an embodiment of a storage module performing a read operation.

FIG. 12 is a schematic sequence diagram of an embodiment of a storage module performing a read operation. Referring to FIG. 10 and FIG. 12, in a first period P1, the processing module 230 may output a high level by using the control line C1, to enable the storage components 241 and 242 on a first horizontal line to perform a read action. In addition, in a second period P2, the processing module 230 may output a high level by using the control line C2, to enable the storage components 243 and 244 on a second horizontal line to perform a read action.

In the first period P1, the processing module 230 may output a high level by using the transmission lines L11 and L21, output a low level by using the transmission lines L15 and L25, and read values stored in the storage components 241 and 242 respectively by using the transmission lines L13 and L23. Herein, the processing module 230 may read logic "1" by using the transmission line L13, and read logic "0" by using the transmission line L23, as shown in FIG. 12. Because the transmission lines L12, L14, L22, and L24 cannot output a signal, they are not shown in the figures.

In the second period P2, the processing module 230 may also output a high level by using the transmission lines L11 and L21, output a low level by using the transmission lines L15 and L25, and read values stored in the storage components 243 and 244 respectively by using the transmission lines L13 and L23. Herein, the processing module 230 may read logic "0" by using the transmission line L13, and read logic "1" by using the transmission line L23, as shown in FIG. 12. Because the transmission lines L12, L14, L22, and L24 cannot output a signal, they are not shown in the figures.

In conclusion, in an electronic apparatus capable of predicting a remaining service life and a display apparatus capable of predicting a remaining service life in the embodiments of the present invention, while an operation signal is used to drive a circuit whose remaining service life needs to be predicted, a test signal whose electrical characteristic is greater than that of the operation signal is used to drive an additionally disposed small size circuit of the circuit whose remaining service life needs to be predicted, and an operation time of the small size circuit is accumulated, so that when whether the small size circuit is faulty is determined according to a result signal generated by the small size circuit, a remaining service life of the circuit whose remaining service life needs to be predicted is calculated according to the test signal, the operation signal, and the operation time, so as take preventive measures in advance.

The technical content of the present invention is disclosed above by using preferred embodiment, but is not intended to limit the present invention. Changes and modifications made by any person skilled in the art without departing from the spirit of the present invention all fall within the scope of the present invention. Therefore, the protection scope of the present invention shall be subject to the appended claims.

What is claimed is:

1. An electronic apparatus with a detection function, comprising:

a normal function circuit, which operates according to an operation signal;

a dummy function circuit, which operates according to a test signal to generate a result signal, wherein the dummy function circuit is a small size circuit of the normal function circuit, the test signal and the operation signal are same function signals, and the test signal has an electrical characteristic greater than that of the operation signal; and a processor configured to generate the operation signal and the test signal at the same time, for accumulating an operation time of the dummy function circuit and detecting the result signal to determine whether the dummy function circuit is faulty, and when the dummy function circuit is faulty, calculating a remaining service life of the normal function circuit according to the test signal, the operation signal, and the operation time.

2. The electronic apparatus with a detection function according to claim 1, wherein the electrical characteristic is a frequency, a level, an amplitude, or a combination thereof.

3. The electronic apparatus with a detection function according to claim 1, wherein the electrical characteristic is a frequency, and the processor is configured to obtain the remaining service life by subtracting the operation time from a product obtained by multiplying a ratio of a frequency of the test signal to a frequency of the operation signal by the operation time.

4. The electronic apparatus with a detection function according to claim 3, further comprising a storage module, configured to store the operation time.

5. The electronic apparatus with a detection function according to claim 1, further comprising a substrate, wherein the normal function circuit, the dummy function circuit, and the processor are disposed on the substrate.

6. The electronic apparatus with a detection function according to claim 1, wherein the normal function circuit and the dummy function circuit are formed in a same process procedure.

7. The electronic apparatus with a detection function according to claim 1, wherein the processor is configured to generate a warning signal when the dummy function circuit is faulty.

8. A display apparatus with a detection function, comprising:

a display panel;

a normal driving circuit configured to drive the display panel according to an operation signal, wherein the normal driving circuit comprises a first quantity of driving units;

a dummy driving circuit configured to operate according to a test signal to generate a result signal, wherein the dummy driving circuit comprises a second quantity of the driving units, and wherein the first quantity is greater than the second quantity, the test signal and the operation signal are same function signals, and the test signal has an electrical characteristic greater than that of the operation signal; and a processor configured to generate the operation signal and the test signal at the same time, for accumulating an operation time of the dummy driving circuit and detecting the result signal to determine whether the dummy driving circuit is faulty, and when the dummy driving circuit is faulty, calculating a remaining service life of the normal driving circuit according to the test signal, the operation signal, and the operation time.

9. The display apparatus with a detection function according to claim 8, wherein the electrical characteristic is a frequency, a level, an amplitude, or a combination thereof.

10. The display apparatus with a detection function according to claim 9, wherein when the electrical characteristic is a frequency, the processor obtains the remaining service life by subtracting the operation time from a product obtained by multiplying a ratio of a frequency of the test signal to a frequency of the operation signal by the operation time.

* * * * *